US005153098A

United States Patent [19]

Takagi

[11] Patent Number: 5,153,098

[45] Date of Patent: Oct. 6, 1992

[54] IMAGE FORMING METHOD

[75] Inventor: Yoshihiro Takagi, Kanagawa, Japan

[73] Assignee: Fuji Photo Film Co., Ltd., Kanagawa, Japan

[21] Appl. No.: 668,793

[22] Filed: Feb. 25, 1991

Related U.S. Application Data

[63] Continuation of Ser. No. 420,506, Oct. 11, 1989, abandoned.

[30] Foreign Application Priority Data

Oct. 13, 1988 [JP] Japan ..... 63-257659

[51] Int. Cl.[5] ..... G03C 1/06

[52] U.S. Cl. ..... 430/264; 430/265; 430/567; 430/598

[58] Field of Search ..... 430/264, 265, 567, 598

[56] References Cited

U.S. PATENT DOCUMENTS

| | | | |
|---|---|---|---|
| 4,824,764 | 4/1989 | Inagaki et al. | 430/264 |
| 4,851,321 | 7/1989 | Takagi et al. | 430/264 |
| 4,865,947 | 9/1989 | Kuwabara et al. | 430/264 |
| 4,873,172 | 10/1989 | Ishiguro et al. | 430/264 |
| 4,873,173 | 10/1989 | Sasaoka et al. | 430/964 |
| 4,965,169 | 10/1990 | Hirano et al. | 430/264 |
| 5,030,547 | 7/1991 | Katoh et al. | 430/264 |
| 5,075,198 | 12/1991 | Katoh | 430/264 |

FOREIGN PATENT DOCUMENTS

| | | | |
|---|---|---|---|
| 0286062 | 10/1988 | European Pat. Off. | 430/598 |
| 63-286840 | 11/1988 | Japan | 430/598 |

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

An image forming method for forming a black-and-white image with a gamma value of at least 8 is disclosed, which comprises processing an imagewise expsed negative type photographic material having at least one silver halide emulsion layer on a support, and containing a hydrazine derivative represented by formula (I) in the emulsion layer or in another hydrophilic colloid layer on the support, with a developer having a pH of 11.2 or less, wherein the silver halide grains are octahedral or tetradecahedral grains:

(I)

wherein $R_1$ represents an aliphatic or aromatic group, $R_2$ represents a hydrogen atom, an alkyl group, an aryl group, an alkoxy group, an aryloxy group, an amino group, a carbamoyl group or an oxycarbonyl group, $G_1$ represents a carbonyl group, a sulfonyl group, a sulfoxy group group, or an iminomethylene group, and $A_1$ and $A_2$ each represents a hydrogen atom, or one is a hydrogen atom and the other is a substituted or unsubstituted alkylsulfonyl group, a substituted or unsubstituted arylsulfonyl group, or a substituted or unsubstituted acyl group.

6 Claims, No Drawings

IMAGE FORMING METHOD

This is a continuation of application Ser. No. 07/420,506 filed Oct. 11, 1989 abandoned.

FIELD OF THE INVENTION

The present invention relates to the field of photographic plate making, and more particularly relates to silver halide photographic materials (particularly negative type) for rapidly forming a supercontrast image with a processing solution of high stability.

BACKGROUND OF THE INVENTION

The formation of very high contrast photographic images using certain types of silver halides is known, and such methods of forming photographic images are used in the field of photographic plate making.

Special developing solutions, called lithographic developers, are used for these prior objectives. Lithographic developers contain only hydroquinone as the developing agent. In order to prevent infectious development, sulfite as a preservative is used in the form of an addition product with formaldehyde, and the concentration of free sulfite ions is made very low (ordinarily below 0.1 mol/l). Because of this, a lithographic developer undergoes air oxidation very easily, and has the great deficiency of being not preservable more than 3 days.

Methods for obtaining high contrast photographic properties using stable developers include methods using hydrazine derivatives described in U.S. Pat. Nos. 4,224,401, 4,168,977, 4,166,742, 4,311,781, 4,272,606, 4,211,857 and 4,243,739. These methods give high sensitivity with supercontrast, and permit additions of high sulfite concentrations in the developer. This markedly raises its stability against air oxidation, compared to lithographic developer.

However, these supercontrast image forming methods using hydrazine compounds have problems in that, in order to promote strong infectious development, the parts that should have been narrow white places, when photographing low contrast manuscript writing (particularly the fine lines of Ming-style characters), are blackened so that the characters became smudged with black, and are difficult to discern. Because of this, when the exposure was lowered to match the fine lines of the Ming-style characters, reverse problems occur in that smudging of Gothic letters worsen. Thus the latitude of exposure is narrow. Similar problems also occur in photographing dot images, where darkening tends to occur in the parts left as white space among the dots, and half tone gradation becomes very narrow.

This is caused by the fact that low exposure parts or unexposed parts adjoining the exposed parts end up being developed, because of the strong infectious developability with supercontrast, resulting from the hydrazine compounds. In order to prevent this, development of a method for suppressing image expansion due to infectious development is desired, and development of a method of bringing about a development effect that inhibits development of the parts adjoining the exposed parts (hereafter micro development inhibition) is also desired. Suppressing infectious developability can be attained by reducing the amount of nucleating agents added and lower the pH of the developer. However, practical problems occur in that the tone becomes soft, and line-image sharpness is lost. Also, although various investigations into imparting micro development inhibition in nucleating development systems have been made, no satisfactory method has yet been discovered.

The present invention accomplishes control over nucleating development by using the developer at a pH below 11.2, that is, it accomplishes image expansion and micro development inhibition. Conventionally, when the pH is below 11.2, high contrast images having G (gamma value) of 8 or more cannot be formed, although sufficiently high contrast can be obtained by the combined use of a nucleating accelerator as disclosed in JP-A-63-183438. (The term "JP-A" used herein means an unexamined published Japanese patent application.)

Also, with development at a pH of less than 11.2, obviously infectious developability is weaker and image expansion is smaller in comparison with contrast development at higher pH, and development of the unexposed parts or low exposure parts of the adjoining segments of the image is microscopically controlled. As a result of further analysis, this development effect has been understood as being closely related to the crystal habit of the silver halide.

On the other hand, while it is easy to obtain supercontrast images having G of 8 or more at a pH over 11.2, the stability of the developer worsens, the development agent oxidizes and deteriorates, the pH fluctuates because of the absorption of $CO_2$ from the air, and the photographic characteristics often change. Further the development effects as observed below pH 11.2 cannot be obtained, and the latitude of exposure amounts to provide both Ming-style characters and Gothic characters with satisfactory image qualities is narrow.

SUMMARY OF THE INVENTION

A first object of the present invention is to provide a silver halide photographic material with lines and half tone dots of excellent reproducibility (wide exposure latitude).

A second object of the present invention is to provide a supercontrast image forming method that is capable of maintaining stable performance in stable developers, in systems using hydrazines.

The above objects of the present invention are achieved by an image forming method for forming a high contrast black-and-white image having the gamma value (G) of 8 or more, by processing an image-wise exposed negative type photographic material having at least one silver halide emulsion layer on a support and containing a hydrazine derivative represented by formula (I) in the emulsion layer or in another hydrophilic colloid layer on the support, with a developer having a pH of 11.2 or less, wherein the silver halide grains are octahedral or tetradecahedral grains:

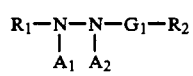

$$R_1-\underset{\underset{A_1}{|}}{N}-\underset{\underset{A_2}{|}}{N}-G_1-R_2 \qquad (I)$$

wherein $R_1$ represents an aliphatic or aromatic group, $R_2$ represents a hydrogen atom, an alkyl group, an aryl group, an alkoxy group, an aryloxy group, an amino group, a carbamoyl group or an oxycarbonyl group, $G_1$ represents a carbonyl group, a sulfonyl group, a sulfoxy group,

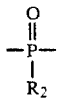

group, or an iminomethylene group, and $A_1$ and $A_2$ each represents a hydrogen atom, or one of them is a hydrogen atom and the other is a substituted or unsubstituted alkylsulfonyl group, a substituted or unsubstituted arylsulfonyl group, or a substituted or unsubstituted acyl group.

DETAILED DESCRIPTION OF THE INVENTION

In formula (I), the aliphatic group represented by $R_1$ is preferably one having 1 to 30 carbon atoms, and particularly preferably a straight chain, branched or cyclic alkyl group having 1 to 20 carbon atoms. The cyclic alkyl group may be cyclized so as to form saturated heterocyclic ring containing one or more hetero atoms therein. Also, the alkyl group may be substituted with substituent groups of 1 to 60 carbon atoms and preferably 1 to 40 carbon atoms, such as aryl groups, alkoxy groups, sulfoxy groups, sulfonamide groups and carbonamide groups.

In formula (I), the aromatic group represented by $R_1$ can be a monocyclic or bicyclic aryl group or an unsaturated heterocyclic group. The unsaturated heterocyclic group may be bonded with a monocyclic or bicyclic aryl group to form a hetero aryl group. Examples of such groups include benzene rings, naphthalene rings, pyridine rings, pyrimidine rings, imidazole rings, pyrazole rings, quinoline rings, isoquinoline rings, benzimidazole rings, thiazole rings and benzothiazole rings, among which those containing benzene rings are preferred.

Aryl groups are particularly preferred as $R_1$.

The aryl group or unsaturated heterocyclic group of $R_1$ may be substituted, and representative substituents include straight chain, branched or cyclic alkyl groups (preferably those having of 1 to 20 carbon atoms), aralkyl groups (preferably monocyclic or bicyclic groups whose alkyl moieties have 1 to 3 carbon atoms), alkoxy groups (preferably those having 1 to 20 carbon atoms), substituted amino groups (preferably amino groups substituted with alkyl groups having 1 to 20 carbon atoms), acylamino groups (preferably having 2 to 30 carbon atoms), sulfonamido groups (preferably those having 1 to 30 carbon atoms), and ureido groups (preferably those having 1 to 30 carbon atoms).

The alkyl group represented by $R_2$ in formula (I) preferably is an alkyl group with 1 to 4 carbon atoms, and may be substituted with substituent groups such as halogen atoms, cyano groups, carboxy groups, sulfo groups, alkoxy groups and phenyl groups.

The aryl group represented by $R_2$ preferably is a monocyclic or bicyclic aryl group, for example, a benzene ring. The aryl group may be substituted with, for example, halogen atoms, alkyl groups, cyano groups, carboxyl groups and sulfo groups.

Alkoxy groups having 1 to 8 carbon atoms are preferred as the alkoxy group, and such may be substituted with halogen atoms and aryl groups.

Monocyclic groups are preferred as the aryloxy group, and such may be substituted with halogen atoms.

Preferred amino groups include an unsubstituted amino group, alkylamino groups having 1 to 10 carbon atoms and arylamino groups, and they may be substituted with alkyl groups, halogen atoms, cyano groups, nitro groups and carboxy groups.

Preferred carbamoyl groups are an unsubstituted carbamoyl group, alkylcarbamoyl groups having 2 to 10 carbon atoms and arylcarbamoyl groups, and they may be substituted with alkyl groups, halogen atoms, cyano groups and carboxy groups.

Preferred oxycarbonyl groups are aryloxycarbonyl groups and alkoxycarbonyl groups with 2 to 10 carbon atoms, and they may be substituted with alkyl groups, halogen atoms, cyano groups and nitro groups.

Of the groups represented by $R_2$, when $G_1$ is a carbonyl group, preferred groups are a hydrogen atom, an alkyl group (for example, methyl, trifluoromethyl, 3-hydroxypropyl and 3-methanesulfonamidopropyl), an aralkyl group (for example, o-hydroxybenzyl) and an aryl group (for example, phenyl, 3,5-dichlorophenyl, o-methanesulfonamidophenyl and 4-methanesulfonylphenyl), with a hydrogen atom being preferred.

When $G_1$ is a sulfonyl group, it is preferred that $R_2$ be an alkyl group (for example, methyl), an aralkyl group (for example, o-hydroxyphenylmethyl), an aryl group (for example, phenyl), or a substituted amino group (for example, dimethylamino).

When $G_1$ is a sulfoxy group, it is preferred for $R_2$ to be a cyanobenzyl group or a methylthiobenzyl group.

When $G_1$ is a

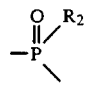

group, it is preferred that $R_2$ be a methoxy group, an ethoxy group, a butoxy group, a phenoxy group or a phenyl group, with a phenoxy group being especially preferred.

When $G_1$ is an N-substituted or unsubstituted iminomethylene group, $R_2$ preferably is a methyl group, an ethyl group, or a substituted or unsubstituted phenyl group.

The substituent groups cited relative to $R_1$ above can be substituents for the $R_2$ substituted group, but others can also be used, such as acyl groups, acyloxy groups, alkoxycarbonyl groups, aryloxycarbonyl groups, alkenyl groups, alkynyl groups and nitro groups.

Carbonyl groups are most preferred as the G of formula (I).

Also, $R_2$ may be a moiety that will cleave the $—G_1—R_2$ moiety from the residual molecules and bring about a cyclization reaction to form a cyclic structure containing the atoms of the $—G—R_2$ moiety, that can represented by formula (a).

$$—R_3—Z_1 \qquad \text{(a)}$$

wherein $Z_1$ is a group capable of nucleophilically attacking $G_1$, and is a group that cleaves the $G_1—R_3—Z_1$ moiety from the residual molecules, and $R_3$ is a group removing a hydrogen atom from the group of $R_2$ and allowing $Z_1$ to attack $G_1$ nucleophilically to form a cyclic structure with $G_1$, $R_3$ and $Z_1$.

In further detail, $Z_1$ is a group capable of releasing the $R_1—N=N$ group from $G_1$ by nucleophilic reaction with the intermediate having the following formula formed upon oxidation of the hydrazine compound of formula (I).

$R_1—N=N—G_1—R_3—Z_1$

More specifically, $Z_1$ may be a functional group that reacts directly with $G_1$ such as —OH, —COOH, —SH or $—NHR_4$, wherein $R_4$ is a hydrogen atom, an alkyl group of 1 to 30 carbon atoms (e.g., methyl, ethyl), an aryl group of 6 to 20 carbon atoms (e.g., phenyl, naphthyl), $—COR_5$ or $—SO_2R_5$, and $R_5$ represents a hydrogen atom, an alkyl group of 1 to 30 carbon atoms (e.g., methyl, ethyl), an aryl group of 6 to 20 carbon atoms (e.g., phenyl, naphthyl) or a hetero cyclic group of 1 to 20 carbon atoms (e.g., pyridyl). Here, $Z_1$ may be a temporarily protected precursor that form —OH, —COOH, —SH or $—NHR_4$ upon hydrolysis with alkali. $Z_1$ may also be a functional group capable of reacting with $G_1$ by reacting with nucleophilic agents such as sulfite ions and hydroxide ions such as

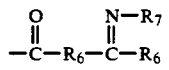

wherein $R_6$ and $R_7$ each represents a hydrogen atom, an alkyl group of 1 to 30 carbon atoms (e.g., methyl, ethyl), an alkenyl group of 2 to 30 carbon atoms, an aryl group of 6 to 20 carbon atoms (e.g., phenyl, naphthyl) or a hetero cyclic group of 1 to 20 carbon atoms (e.g., pyridyl).

Preferred cyclic groups for forming $G_1$, $R_3$ and $Z_1$ are 5-membered or 6-membered rings. Of those represented by formula (a), those represented by formulas (b) and (c) are preferred.

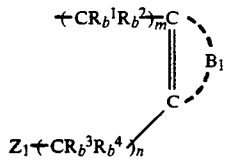

(b)

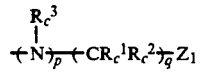

(c)

In formula (b), $R_b^1$ to $R_b^4$ which may be the same or different, each represents a hydrogen atom, an alkyl group (preferably with 1 to 12 carbon atoms), an alkenyl group (preferably with 2 to 12 carbon atoms) and an aryl group (preferably with 6 to 12 carbon atoms); $B_1$ represents atoms needed to complete a 5-membered or 6-membered ring which may be substituted; and m and n are 0 or 1 and (n+m) is 1 or 2. $Z_1$ is the same as in general formula (a).

Examples of suitable 5-membered or 6-membered ring formed by $B_1$ are a cyclohexene ring, a cycloheptene ring, a benzene ring , a naphthalene ring, a pyridine ring and a quinoline ring.

In formula (c), $R_c^1$ and $R_c^2$ which may be the same or different, each represents a hydrogen atom, an alkyl group of 1 to 30 carbon atoms (e.g., methyl, ethyl), an alkenyl group of 2 to 30 carbon atoms, an aryl group of 6 to 20 carbon atoms (e.g., phenyl) or halogen atoms; $R_c^3$ represents a hydrogen atom, an alkyl group of 1 to 30 carbon atoms (e.g., methyl, ethyl), an alkenyl group of 2 to 30 carbon atoms or an aryl group of 6 to 20 carbon atoms (e.g., phenyl); p is 0 or 1; and q is 1 to 4. $Z_1$ is the same as in formula (a).

$R_c^1$, $R_c^2$ and $R_c^3$ may combine and form a ring so long as a structure where $Z_1$ is capable of intramolecular nucleophilic attack on $G_1$ exists.

$R_c^1$ and $R_c^2$ are preferably hydrogen atoms, halogen atoms or alkyl groups, and $R_c^3$ is preferably an alkyl group or an aryl group.

q preferably is 1 to 3, and, when q is 2 or 3, $CR_c^1R_c^2$ may be the same or different.

$A_1$ and $A_2$, which may be the same or different, each represents a hydrogen atom, an alkylsulfonyl group with 20 or less carbon atoms and an arylsulfonyl groups (preferably a phenylsulfonyl group or a phenylsulfonyl group substituted in a manner that the sum of Hammett's substituent constant is not less than −0.5), an acyl group with 20 or less carbon atoms such as a benzoyl group, a benzoyl group substituted in a manner that the sum of Hammett's substituent constant is not less than −0.5 and an unsubstituted or substituted straight chain, branched or cyclic aliphatic acyl groups (where the substituent groups may be, for example, halogen atoms, ether groups, sulfonamide groups, carbonamide groups, hydroxyl groups, carboxy groups and sulfonic acid groups).

$A_1$ and $A_2$ are most preferably hydrogen atoms.

$R_1$ or $R_2$ of formula (I) may contain a ballast group conventionally used in immobile photographic additives such as couplers. The ballast group is a group that is comparatively inert photographically, has 8 or more carbon atoms, and can be selected, for example, from alkyl groups, alkoxy groups, phenyl groups, alkylphenyl groups, phenoxy groups and alkylphenoxy groups.

$R_1$ or $R_2$ of formula (I) may contain groups that enhance the adsorptivity on silver halide grain surfaces. Suitable adsorbing groups include thiourea groups, heterocyclic thioamido groups, mercapto heterocyclic groups and triazole groups as described in U.S. Pat. Nos. 4,385,108 and 4,459,347, and in JP-A-59-195233, JP-A-59-200231, JP A-59-201045, JP-A-59-201046, JP-A-59-201047, JP-A-59-201048, JP-A-59-201049, JP-A-61-170733, JP-A-61-270744, JP-A-62-948, JP-A-63-234244, and in Japanese Patent Application Nos. 62-67501 and 62-67510.

Specific examples of compounds represented by formula (I) are given below. However, the present invention is not to be construed as being limited to compounds shown below.

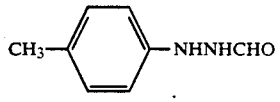

I-1)

-continued
I-2)
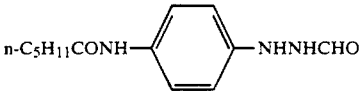
I-3)
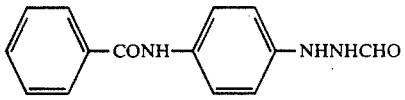
I-4)
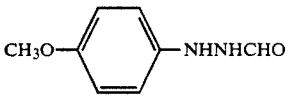
I-5)
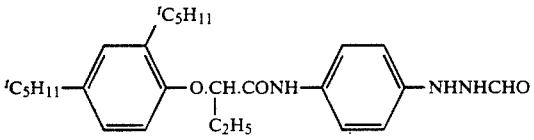
I-6)
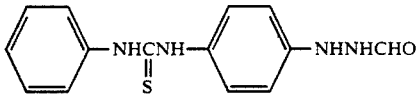
I-7)
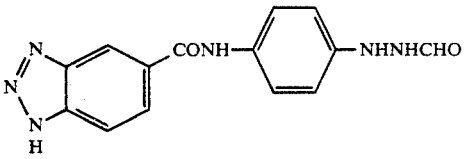
I-8)
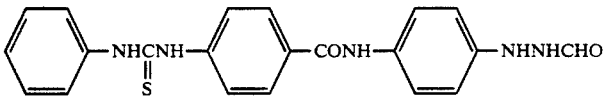
I-9)
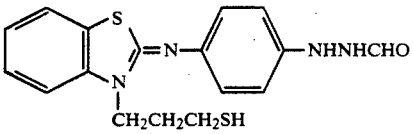
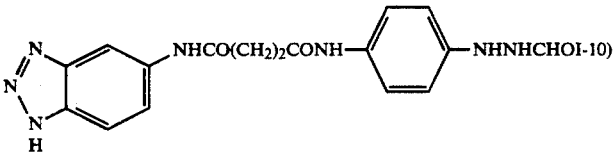
I-11)
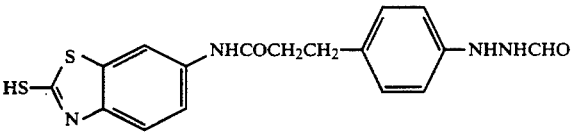
I-12)
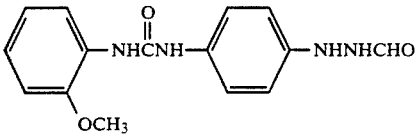

-continued
I-13)
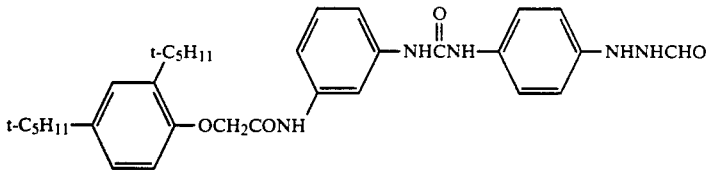
I-14)
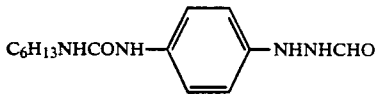
I-15)
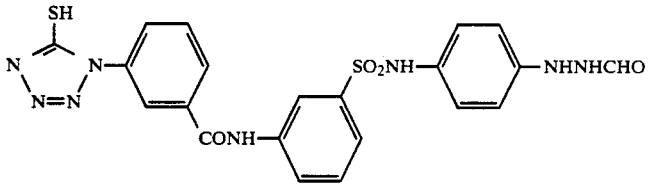
I-16)
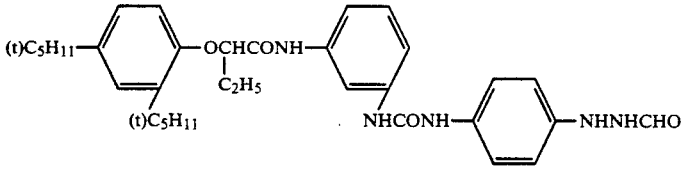
I-17)
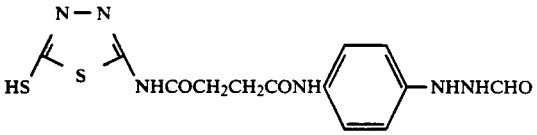
I-18)
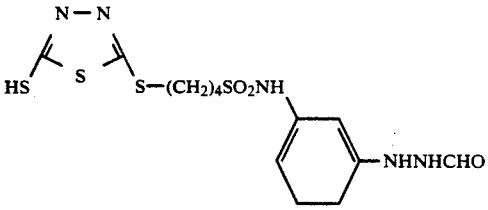
I-19)
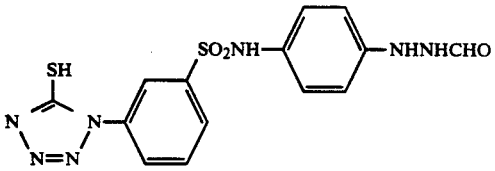
I-20)
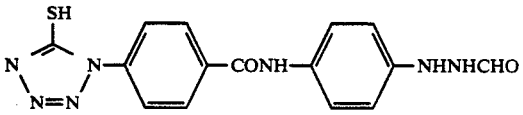
I-21)
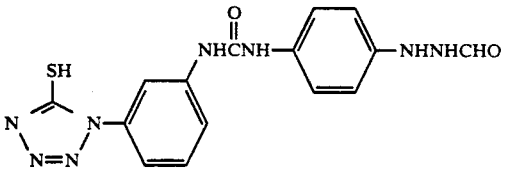

-continued
I-22)
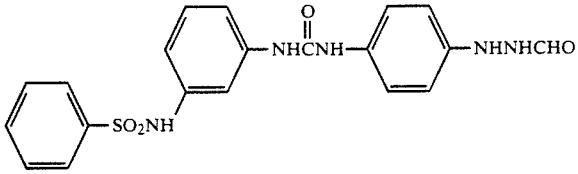
I-23)
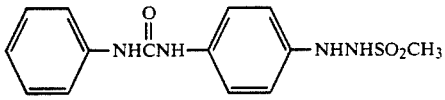
I-24)
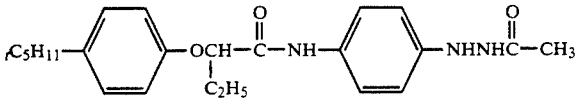
I-25)
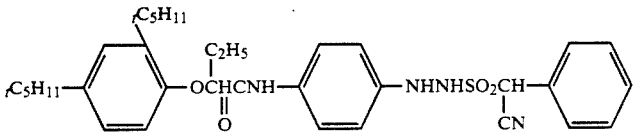
I-26)
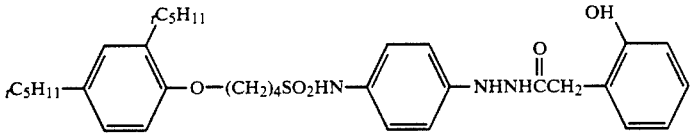
I-27)
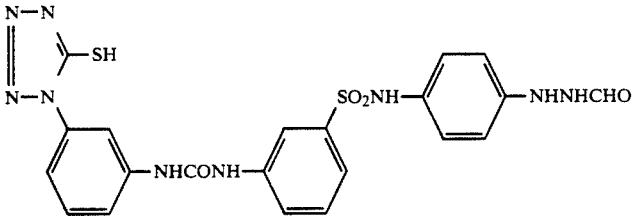
I-28)
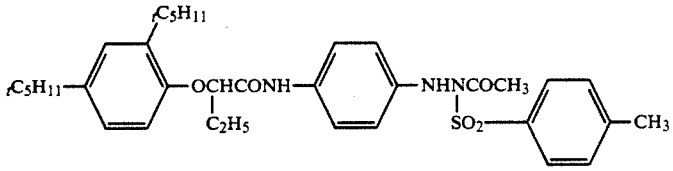
I-29)
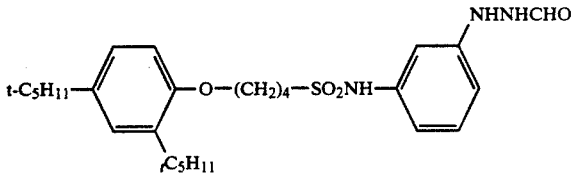
I-30)
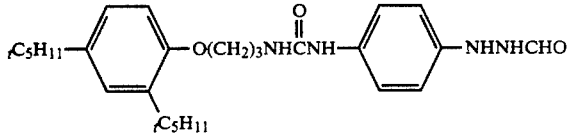
I-31)
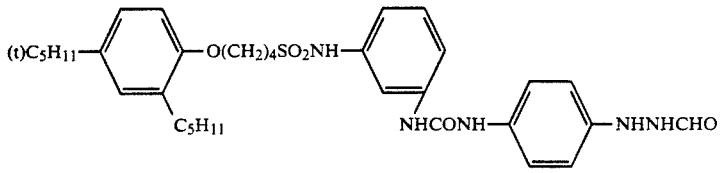

-continued
I-32)
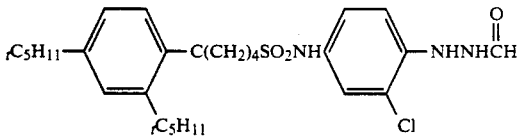
I-33)
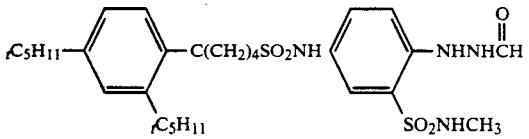
I-34)
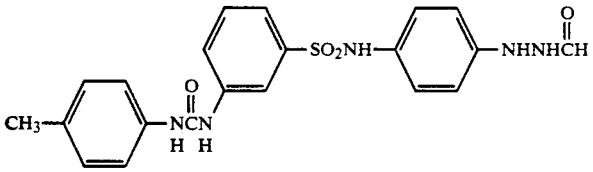
I-35)
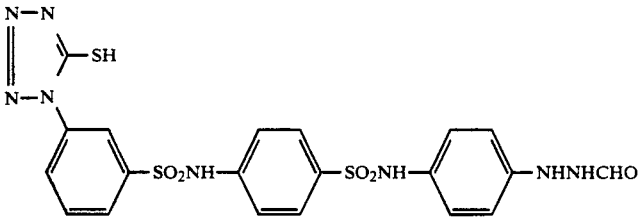
I-36)
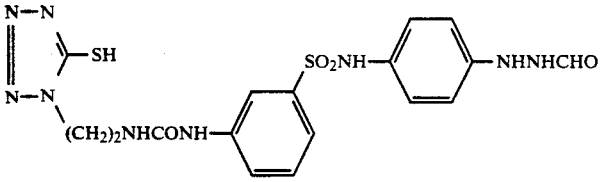
I-37)
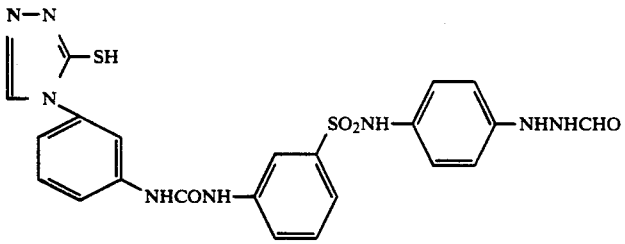
I-38)
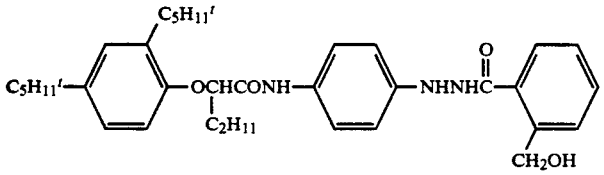
I-39)
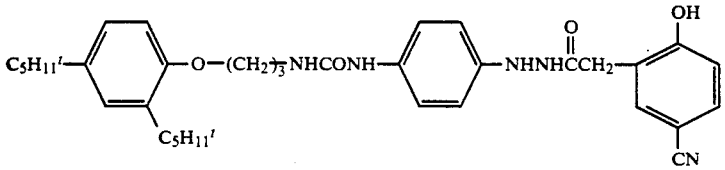

-continued

I-40)

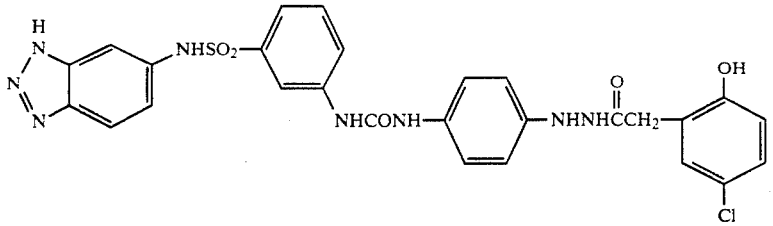

I-41)

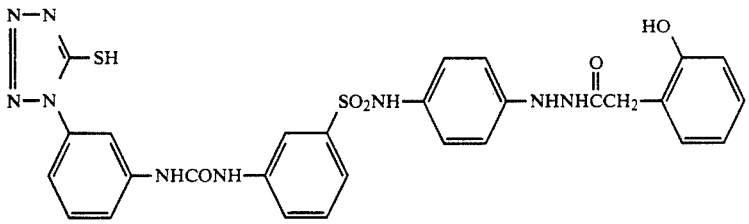

I-42)

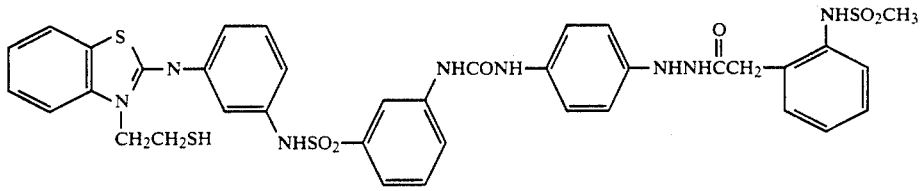

I-43)

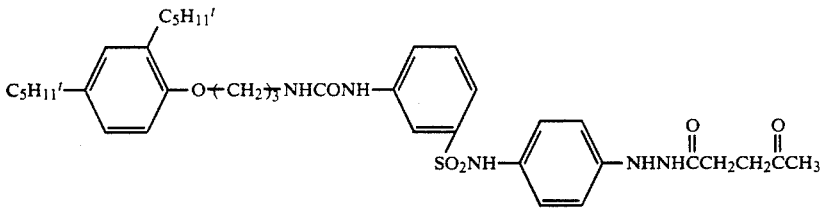

I-44)

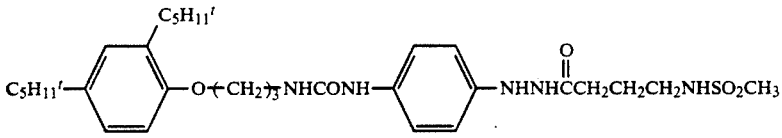

I-45)

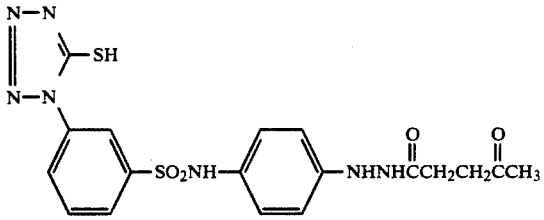

In addition to the above, it is also possible to use, as the hydrazine derivatives of the present invention, those disclosed in the references cited in *Research Disclosure Item* 23516 (November, 1983, page 346), and those described in U.S. Pat. Nos. 4,080,207, 4,269,929, 4,276,364, 4,278,748, 4,385,108, 4,459,347, 4,560,638 and 4,478,928, in British Patent 2,011,391B, in JP-A-60-179734, JP-A-61-170733, JP-A-61-270744, JP-A-62-948, in European Patent 217,310, and in JP-A-63-32538, JP-A-63-104047, JP-A-63-121838, JP-A-63-129337, JP-A-63-234244, JP-A-63-234245, JP-A-63-234246, JP-A-63-223744, and Japanese Patent Application Nos. 62-130819, 62-143469 and 62-166117.

The amount of the hydrazine derivative employed in the present invention is preferably $1\times10^{-6}$ mol to $5\times10^{-2}$ mol per mol of silver halide, with amounts in the range of $1\times10^{-5}$ mol to $2\times10^{-2}$ mol being particularly preferred.

Any method may be used to obtain an image with G of at least 8 in a developer with pH under 11.2, and it is possible to use a compound of formula (II) shown below as a nucleating accelerator.

$$Y\text{-}(X)_n A\text{-}B]_m \qquad \text{(II)}$$

In formula (II), Y represents a group capable of adsorption on silver halide, X represents a divalent linking group comprising an atom or an atomic group selected from hydrogen atoms, carbon atoms, nitrogen atoms, oxygen atoms or sulfur atoms, A represents a divalent linking group, and B represents an amino group, an ammonium group or a nitrogen-containing heterocyclic group, wherein the amino group may be substituted. m is 1, 2 or 3, and n is 0 or 1.

Nitrogen-containing heterocyclic compounds are those groups that will adsorb on silver halide as represented by Y.

When Y represents a nitrogen-containing heterocyclic group, the compound of formula (II) can be represented by formula (III) below.

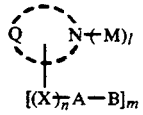

(III)

In formula (III), l is 0 or 1, m is 1, 2 or 3, and n is 0 or 1, $[(X)_n-A-B]_m$ is the same as that in formula (II), and Q represents the atoms required to form a 5- or 6-membered heterocyclic ring composed of at least one of nitrogen atoms, oxygen atoms and sulfur atoms. Also, this heterocyclic ring- may be condensed with a carbocyclic aromatic ring or a heterocyclic aromatic ring.

The heterocyclic ring formed by Q may be a substituted or unsubstituted indazole, benzimidazole, benztriazole, benzoxazole, benzthiazole, imidazole, thiazole, oxazole, triazole, tetrazole, azaindene, pyrazole, indole, triadine, pyrimidine, pyridine and quinoline.

M represents a hydrogen atom, an alkali metal atom (for example, sodium and potassium), an ammonium group (for example, trimethylammonium and dimethylbenzylammonium), and groups capable of becoming M=H or alkali metal atoms under alkali conditions (for example, acetyl, cyanoethyl and methanesulfonylethyl).

Also, these heterocyclic rings may be substituted with substituent groups such as nitro groups, halogen atoms (for example, chlorine and bromine), mercapto groups, cyano groups, substituted or unsubstituted alkyl groups (for example, methyl, ethyl, propyl, t-butyl, cyanoethyl, methoxyethyl and methylthioethyl), aryl groups (for example, phenyl, 4-methanesulfonamidophenyl, 4-methylphenyl, 3,4-dichlorophenyl and naphthyl), alkenyl groups (for example, allyl), aralkyl groups (for example, benzyl, 4-methylbenzyl and phenethyl), alkoxy groups (for example, methoxy and ethoxy), aryloxy groups (for example, phenoxy and 4-methoxyphenoxy), alkylthio groups (for example, methylthio, ethylthio and methoxyethylthio), arylthio groups (for example, phenylthio), sulfonyl groups (for example, methanesulfonyl, ethanesulfonyl and p-toluenesulfonyl), carbamoyl groups (for example, unsubstituted carbamoyl, methylcarbamoyl and phenylcarbamoyl), sulfamoyl groups (for example, unsubstituted sulfamoyl, methylsulfamoyl and phenylsulfamoyl), carbonamide groups (for example, acetoamide and benzamide), sulfonamide groups (for example, methanesulfonamide, benzenesulfonamide, and p-toluenesulfonamide), acyloxy groups (for example, acetyloxy and benzoyloxy), sulfonyloxy groups (for example, methanesulfonyloxy), ureido groups (for example, unsubstituted ureido, methylureido, ethylureido and phenylureido), thioureido groups (for example, unsubstituted thioureido and methylthioureido), acyl groups (for example, acetyl and benzoyl), heterocyclic groups (for example, 1-morpholino, 1-piperidine, 2-piperidine, 4-piperidine, 2-thienyl, 1-pyrazole, 1-imidazolyl and 2-tetrahydrofuryl), oxycarbonyl groups (for example, methoxycarbonyl and phenoxycarbonyl), oxycarbonylamino groups (for example, methoxycarbonylamino, phenoxycarbonylamino and 2-ethylhexyloxycarbonylamino), amino groups (for example, unsubstituted amino, dimethylamino, methoxyethylamino and anilino), carboxylic acids or their salts, sulfonic acids or their salts, and hydroxy groups.

The divalent linking group represented by X may be, for example, a group such as —S—, —O—,

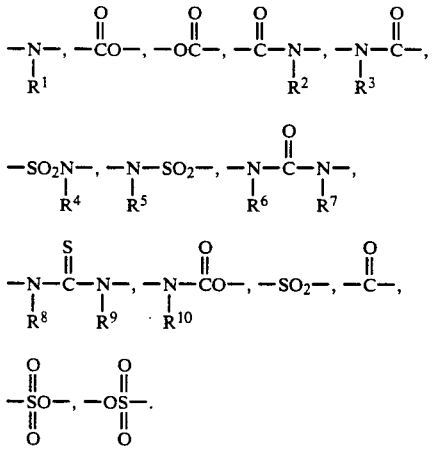

These groups may be bonded with Q by straight chain or branched alkylene groups (for example, methylene, ethylene, propylene, butylene, hexylene and 1-methylethylene). $R^1$, $R^2$, $R^3$, $R^4$, $R^5$, $R^6$, $R^7$, $R^8$, $R^9$ and $R^{10}$, which may be the same or different, each represent a hydrogen atom, a substituted or unsubstituted alkyl group (for example, methyl, ethyl, propyl and n-propyl), a substituted or unsubstituted aryl group (for example, phenyl and 2-methylphenyl), a substituted or unsubstituted alkenyl group (for example, propenyl and 1-methylvinyl) or a substituted or unsubstituted aralkyl group (for example, benzyl and phenethyl).

A represents a divalent linking group, which may be a straight chain or branched alkylene group (for example, methylene, ethylene, propylene, butylene, hexylene and 1-methylethylene), a straight chain or branched alkenylene group (for example, vinylene and 1-methylvinylene), a straight chain or branched aralkylene group (for example, benzylidene) and an aryl group (for example, phenylene and naphthylene). These groups represented by A may be further substituted by any desired combinations of X and A.

The substituted or unsubstituted amino groups of B can be represented by formula (VIII)

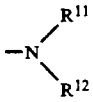

(VIII)

wherein $R^{11}$ and $R^{12}$, which may be the same or different, each represents a hydrogen atom or a substituted or unsubstituted alkyl group, alkenyl group or aralkyl group up to 30 carbon atoms, and these groups may be straight chain (for example, methyl, ethyl, n-propyl, n-butyl, n-octyl, allyl, 3-butenyl, benzyl and 1-naphthylmethyl), branched chain (for example, isopropyl and t-octyl, or cyclic (for example, cyclohexyl).

$R^{11}$ and $R^{12}$ may combined to form a ring, e.g., a saturated heterocyclic ring containing therein one or more hetero atoms (for example, oxygen, sulfur and nitrogen), and specific examples include pyrolidyl ring, piperidyl ring and morpholino ring.

Examples of substituent groups for $R^{11}$ and $R^{12}$ include carboxyl groups, sulfo groups, cyano groups, halogen atoms (for example, fluorine, chlorine and bromine), hydroxy groups, alkoxycarbonyl groups with up to 20 carbon atoms (for example, methoxycarbonyl, ethoxycarbonyl, phenoxycarbonyl and benzyloxycarbonyl), alkoxy groups with up to 20 carbon atoms (for example, methoxy, ethoxy, benzyloxy and phenethyloxy), monocyclic aryloxy groups with up to 20 carbon atoms (for example, phenoxy and p-tolyloxy), acyloxy groups with up to 20 carbon atoms (for example, acetyloxy and propionyloxy), acyl groups with up to 20 carbon atoms (for example, acetyl, propionyl, benzoyl and mesyl), carbamoyl groups (for example, carbamoyl, N,N-dimethylcarbamoyl, morpholinocarbonyl and piperidinocarbonyl), sulfamoyl groups (for example, sulfamoyl, N,N-dimethylsulfamoyl, morpholinosulfonyl and piperidinosulfonyl), acylamino groups with up to 20 carbon atoms (for example, acetylamino, propionylamino, benzoylamino and mesylamino), sulfonamide groups (for example, ethylsulfonamide and p-toluenesulfonamide), carbonamide groups with up to 20 carbon atoms (for example, methylcarbonamide and phenylcarbonamide), ureide groups with up to 20 carbon atoms (for example, methylureido and phenylureido) and amino groups such as those described for formula (VIII).

The ammonium group of B is represented by formula (IX)

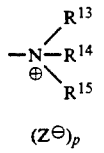

$(Z^{\ominus})_p$ wherein $R^{13}$, $R^{14}$ and $R^{15}$, which may be the same or different, are groups as described for $R^{11}$ and $R^{12}$ in formula (VIII), and $Z^{\ominus}$ represents an anion, which may be exemplified by halide ions (for example, $Cl^{\ominus}$, $Br^{\ominus}$ and $I^{\ominus}$), sulfonate ions (for example, trifluoromethane sulfonate, paratoluene sulfonate, benzene sulfonate and parachlorobenzene sulfonate), sulfate ions (for example, ethyl sulfate, methyl sulfate), perchlorate and tetrafluoroborate, and p represents 0 or 1, and is 0 when the compound forms an intramolecular salt.

The nitrogen-containing heterocyclic ring of B can be a 5- or 6-membered ring containing nitrogen atoms which may be substituted, and may also be condensed with other rings. Suitable nitrogen-containing heterocyclic rings are, for example, imidazolyl groups, pyridyl groups and thiazolyl groups.

Preferred for formula (III) are the compounds represented by formulas (IV), (V), (VI), or (VII) shown below

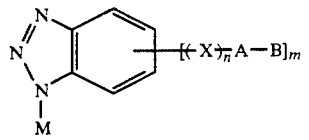

(IV)

-continued

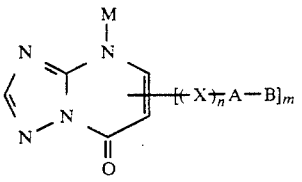

(V)

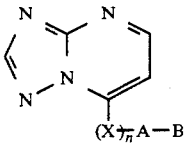

(VI)

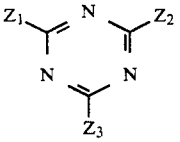

(VII)

wherein $\text{-}(X)_n\text{A—B}$, M and m have the same meaning as given in formula (II), and $Z_1$, $Z_2$ and $Z_3$ either have the same meaning as $\text{-}(X)_n\text{A—B}$ in formula (II) or represent halogen atoms, alkoxy groups with up to 20 carbon atoms (for example, ethoxy), hydroxy groups, hydroxyamino groups, or amino groups which may be substituted with substituent groups such as those described for $R^{11}$ and $R^{12}$ in formula (VIII), provided that at least one of $Z_1$, $Z_2$ and $Z_3$ represents $\text{-}(X)_n\text{A—B}$.

These heterocyclic rings may also be substituted with the substituent groups described for Q in formula (III).

Examples of compounds represented by formula (II) are shown below although the present invention is not to be construed as being limited to these examples.

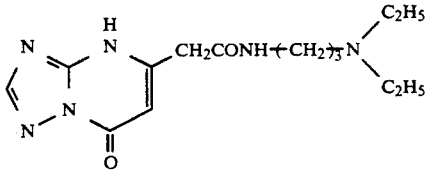

II-1

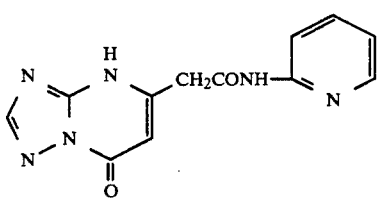

II-2

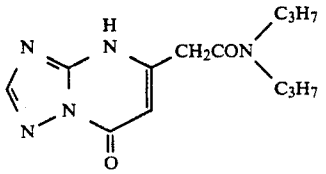

II-3

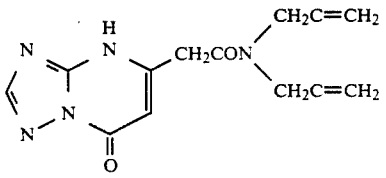

II-4

-continued
II-5
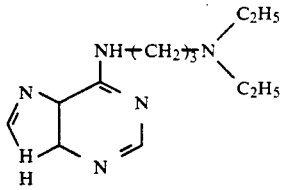
II-6
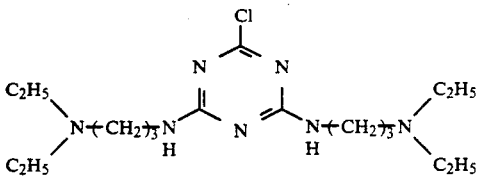
II-7
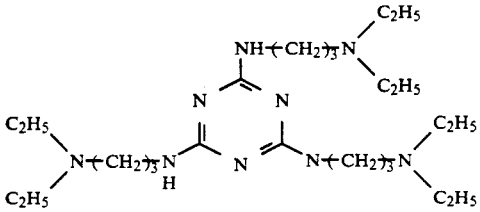
II-8
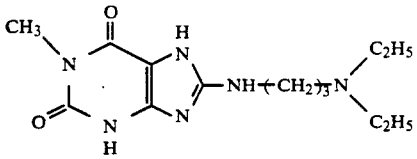
II-9
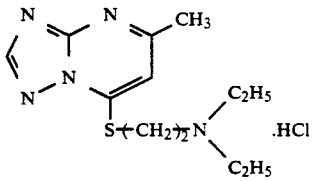
II-10
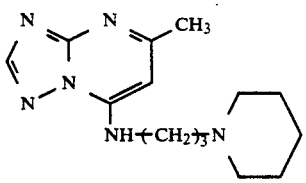
II-11
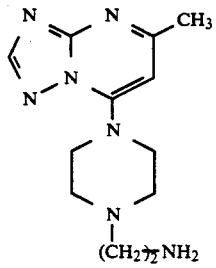
II-12
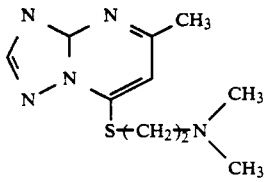
-continued
II-13
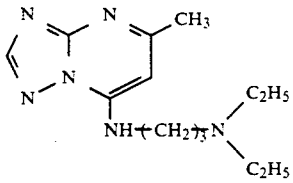
II-14
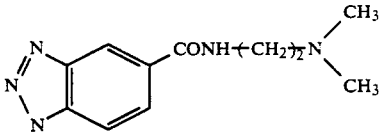
II-15
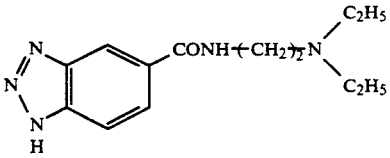
II-16
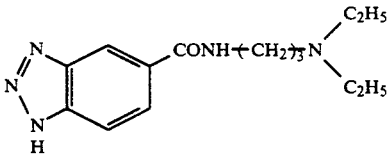
II-17
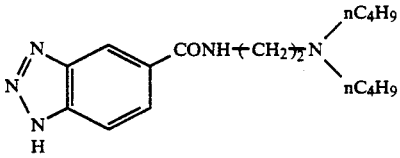
II-18
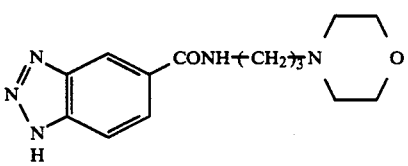
II-19
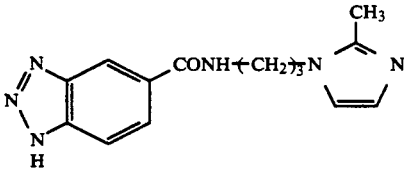
II-20
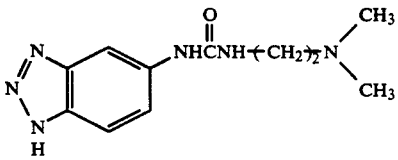
II-21
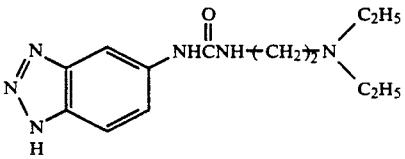

-continued
II-22
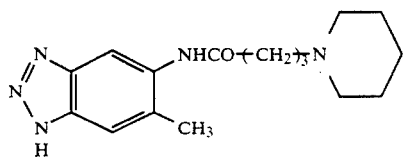
II-23
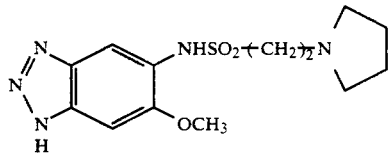
II-24
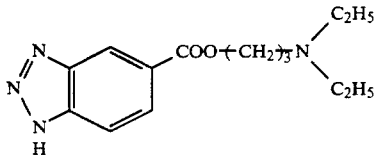
II-25
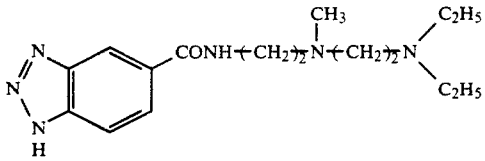
II-26
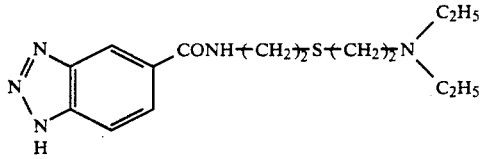
II-27
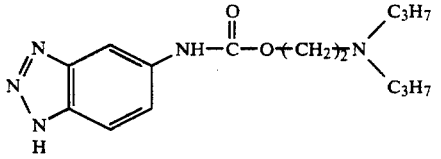
II-28
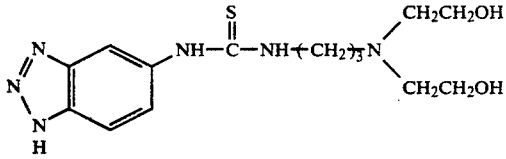
II-29
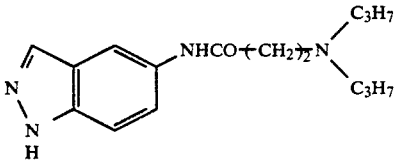
II-30
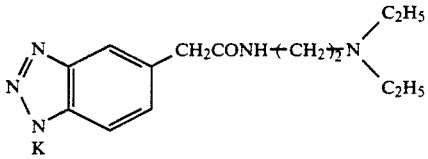
-continued
II-31
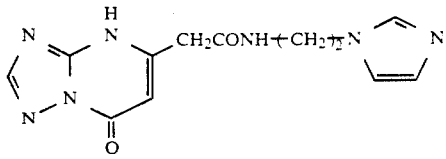
II-32
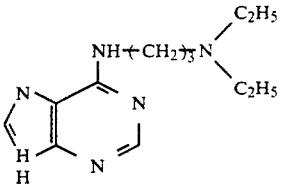
II-33
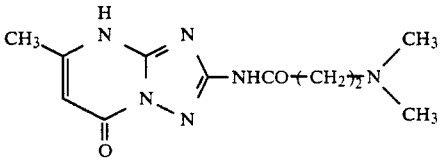
II-34
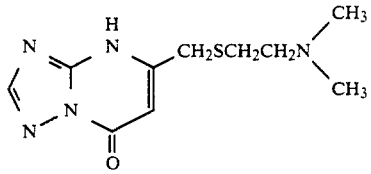
II-35
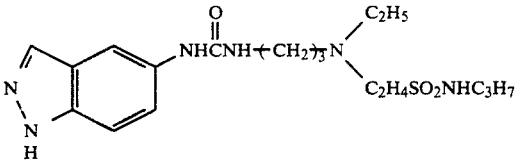
II-36
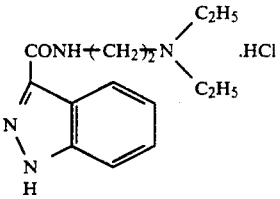
II-37
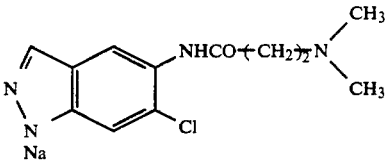
II-38
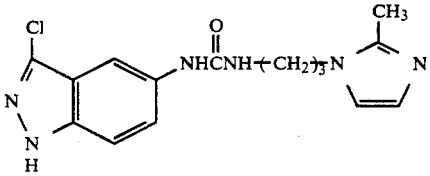
II-39
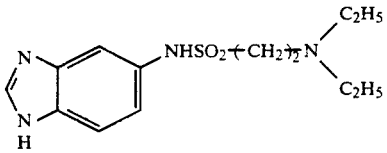

-continued

II-40

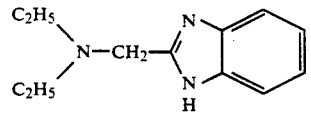

II-41

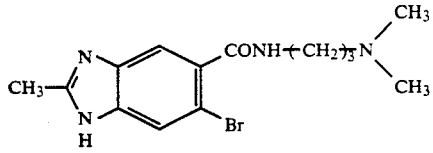

II-42

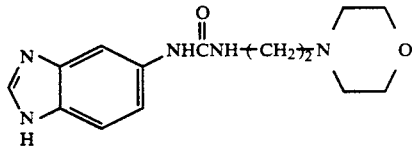

II-43

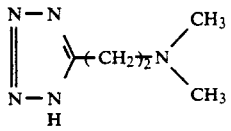

II-44

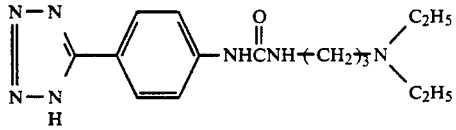

II-45

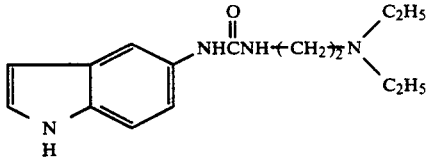

II-46

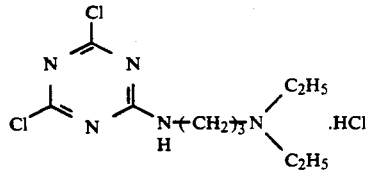

The nucleating accelerator used in the present invention can be easily synthesized by the methods described in *Berichte der Deutschen Chemischen Gesellschaft,* 28, 77 (1895), JP-A-50-37436 and JP-A-51-3231, U.S. Pat. Nos. 3,295,976 and 3,376,310, *Berichte der Deutschen Chemischen Gesellschaft,* 22, 568 (1889), ibid., 29, 2483 (1896), *J. Chem. Soc.,* 1806 (1932), *J. Am. Chem. Soc.,* 71, 4000 (1949), U.S. Pat. Nos. 2,585,388 and 2,541,924, *Advances in Heterocyclic Chemistry,* 9, 165 (1968), *Organic Synthesis,* IV, 569 (1963), *J. Am. Chem. Soc.,* 45, 2390 (1923), *Berichte der Deutschen Chemischen Gesellschaft, Chemische Berichte,* 9, 465 (1876), JP-B-40-28496, JP-A-50-8903, U.S. Patents 3,106,467, 3,420,670, 2,271,229, 3,137,578, 3,148,066, 3,511,663, 3,060,028, 3,271,154, 3,251,691, 3,598,599 and 3,148,066, JP-B-43-4135, U.S. Pat. Nos. 3,615,616, 3,420,664, 3,071,465, 2,444,605, 2,444,606, 2,444,607 and 2,935,404, JP-A-57-202531, JP-A-57-167023, JP-A-57-164735, JP-A-60-80839, JP-A-58-152235, JP-A-57-14836, JP-A-59-162546, JP-A-60-130731, JP-A-60-138548, JP-A-58-83852, JP-A-58-159529, JP-A-159162, JP-A-60-217358 and JP-A-61-80238, and JP-B-60-29390, JP-B-60-29391, JP-B-60-133061 and JP-B-61-1431. (The term "JP-B" used herein means an examined Japanese patent publication.)

The amount of nucleating accelerator which can be used can be varied, depending on the type of compound, but it is preferably from $1.0\times10^{-3}$ to 0.5 g/m$^2$, and more preferably from $5.0\times10^{-3}$ to 0.4 g/m$^2$. These accelerators are added in coating solutions, dissolved in suitable solvents (such as $H_2O$, alcohols such as methanol and ethanol, acetone, dimethylformamide and methylcellosolve).

These additives may be used in combination of described.

It is important that crystal habit of the silver halide used in the present invention is octahedral or tetradecahedral. The silver halide grains having these crystal habits exhibit enhanced development effects as compared to those of other crystal habits such as cube.

The silver halide used in the present invention can be produced by conventional methods such as the neutral method, acid method, ammonia method, direct mixing, reverse mixing, double jet method, controlled double jet method and the core/shell method, as described in, T.H. James, *The Theory of the Photographic Process,* 4th printing, Macmillan Company (1977), pages 88 to 104. Various crystal habits of silver halide grains can be easily obtained by adjusting electric potential (saturated calomel electrode/Ag electrode) during the formation of silver halide grains to a certain level by way of controlling the addition rate of a halide solution, and the controlled double jet method is preferably employed for the formation of octahedral or tetradecahedral grains in the present invention.

As desired, it is possible to control the grain size, grain form and distribution of the silver halide, by using silver halide solvents such as thioethers and thioureas.

While there are no particular limitations as to the grain size, size distribution, crystal form (such as normal crystals, twinned crystals), those having the grain size of 0.05 to 0.8 microns and having a narrow size distribution are preferred.

It is preferred that the grain size distribution be a monodispersion, and by monodispersion is meant a dispersion system where 95% of the grains have mean grain sizes within ±60%, and preferably within ±40%.

Silver bromide, silver iodobromide, silver chlorobromide and silver chloroiodobromide are preferred halogen compositions, and the bromide content is preferably 70 mol % or more, more preferably 80 mol% or more and most preferably over 90 mol %. The silver iodide content is generally not more than 10 mol %, and preferably 5 mol % or less.

Cadmium salts, sulfites, lead salts, thallium salts, rhodium salts or their complex salts, and iridium salts or their complex salts may be present during physical ripening or forming of the silver halide grains.

It is particularly preferred that the iridium salt and the rhodium salt be added in amounts of from $10^{-8}$ to $10^{-5}$ mol and from $10^{-8}$ to $10^{-4}$ mol, respectively, per mol of silver.

These silver halides, after grain formation and desalting, may or may not be chemically sensitized. They can be chemically sensitized by chemical sensitizers such as sulfur sensitizers (for example, sodium thiosulfate and thiourea); noble metal sensitizers (for example, gold sensitizers such as chloroaurates and gold trichloride, palladium sensitizers such as palladium chloride and chloropalladium acid salts, platinium compounds, iridium compounds); selenium sensitizers (for example, selenious acid and selenourea); and reducing sensitizers (for example, stannic chloride, polyamides like diethylenetriamine, sulfite and silver nitrate).

Sensitizing dyes conventionally known for photographic sensitive materials may also be used in the present invention, and examples thereof include cyanine dyes, merocyanine dyes, complex cyanine dyes, complex merocyanine dyes, holopolar cyanine dyes, hemicyanine dyes, styryl dyes and hemioxonol -dyes. Particularly useful dyes are cyanine dyes, merocyanine dyes and complex merocyanine dyes. Any nuclei that are conventionally used in cyanine dyes can be used as basic heterocyclic nuclei in these dyes. That is, pyrroline nuclei, oxazoline nuclei, thiazoline nuclei, pyrrole nuclei, oxazole nuclei, thiazole nuclei, selenazole nuclei, imidazole nuclei, tetrazole nuclei and pyridine nuclei; and, nuclei with alicyclic hydrocarbon rings fused in these nuclei and nuclei with aromatic hydrocarbon rings fused in these nuclei, that is, indolenine nuclei, benzindolenine nuclei, indole nuclei, benzoxazole nuclei, naphthoxazole nuclei, benzothiazole nuclei, naphthothiazole nuclei, benzoselenazole nuclei, benzimidazole nuclei and quinoline nuclei. The carbon atoms of these nuclei may be substituted.

5- or 6-membered heterocyclic nuclei can be used as nuclei having ketomethylene structures, in merocyanine dyes or complex merocyanine dyes, and these include pyrazoline-5-one nuclei, thiohydantoine nuclei, 2-thioxazolidine-2,4-dione nuclei, thiazolidine-2,4-dione nuclei, rhodanine nuclei and thiobarbituric acid nuclei.

Useful sensitizing dyes are those described in, for example, West German Patent 929,080, U.S. Pat. Nos. 2,231,658, 2,493,748, 2,503,776, 2,519,001, 2,912,329, 3,656,959, 3,672,897 and 3,694,217, British Patent 1,242,588, JP-B-44-14030, JP-A-53-137133 and JP-A-55-45015, and JP-A-62-235947.

These sensitizing dyes may be used alone, or may also be used in combination, and combinations of these sensitizing dyes are frequently used for the purpose of supersensitization. Substances that display supersensitization, but themselves do not have a color sensitizing action or do not absorb much visible light, may also be used with the sensitizing dyes.

Additional sensitizing dyes, combinations of dyes displaying supersensitization and substances displaying supersensitization are described in *Research Disclosure* volume 176, 17643 (december 1978), page 23 IV, paragraphs A to J.

Here, the sensitizing dyes can be added at any stage during the processes for manufacturing the photographic emulsion such as the stage of grain formation, physical ripening or chemical ripening, or at any stage after manufacture of the emulsion and up until just before coating.

The sensitizing dyes used in the present invention can be added in organic solvents miscible in aqueous solutions and water, for example, they can be added to the silver halide emulsion as solutions dissolved in solvents such as methanol, ethanol, propyl alcohol, methylcellusolve and pyridine.

The amount of the sensitizing dye employed in the present invention is generally from $10^{-6}$ to $10^{-1}$ mol, preferably from $10^{-4}$ to $10^{-2}$ mol, per mol of silver.

These sensitizing dyes may be used alone or in combination, and combinations of the sensitizing dyes will frequently be used for the purpose of supersensitization.

Water soluble dyes may be present in the sensitive materials used with the present invention, as filter dyes, or for irradiation prevention or for various other purposes. Dyes of this sort include oxonole dyes, benzylidene dyes, merocyanine dyes, cyanine dyes and azo dyes, such as those described in British Patents 584,609 and 1,177,429, JP-A-48-85130, JP-A-49-99620, JP-A-49-114420, JP-A-52-20822, JP-A-59-154439 and JP-A-59-208548, and U.S. Pat. Nos. 2,274,782, 2,533,472, 2,956,879, 3,148,187, 3,177,078, 3,247,127, 3,540,887, 3,575,704, 3,653,905 and 3,718,427. Of these, oxonole dyes, hemioxonole dyes and benzylidene dyes are useful.

The sensitive materials of the present invention may contain various compounds for the purpose of stabilizing photographic performance, or for preventing fog during the process of manufacturing, during storage or during photographic processings of the sensitive material. That is, many compounds known as antifogging agents or as stabilizers can be employed including azoles such as benzothiazolium salts, nitroindazoles, chlorobenzimidazoles, bromobenzimidazoles, mercaptothiazoles, mercaptobenzothiazoles, mercaptothiadiazoles, aminotriazoles, benzothiazoles and nitrobenzotriazoles; mercaptopyrimidines; mercaptotriazines; thioketo compounds like oxazolinethione; azaindenes such as triazaindenes, tetraazaindenes (particularly 4-hydroxy substituted (1,3,3a,7)tetraazaindenes) and pentaazaindenes; benzenethiosulfonic acid; benzenesulfinic acid; benzenesulfonic acid amide; and hydroquinone derivatives. Benzotriazoles (for example, 5-methylbenzotriazole), nitroindazoles (for example, 5-nitroindazole), and hydroquinone derivatives (for example, hydroquinone and methylhydroquinone) are preferred. Also, these compounds may be present in the processing solution.

Inorganic or organic hardeners may be present in the photographic emulsion layer or in another hydrophilic colloid layer in the photographic sensitive material of the present invention. For example, active vinyl compounds (such as 1,3,5-triacryloyl-hexahydro-s-triazine and 1,3-vinylsulfonyl-2-propanol), and active halogen compounds (such as 2,4-dichloro-6-hydroxy-s-triazine) and mucohalogenic acids may be used singly or in combination. Of these, the active vinyl compounds described in JP-A-53-41221, JP-A-53-57257, JP-A-59-162546 and JP-A-60-80846, and the active halogen compounds described in U.S. Pat. No. 3,325,287 are preferred.

The photographic emulsion layer or another hydrophilic colloid layer may also contain various surface active agents for different purposes, such as coating agents, antistatic agents, for improvement of slip properties, for emulsification and dispersion purposes, for adhesion prevention and improvement of photographic characteristics (for example, for accelerating development, increasing contrast or sensitization).

The surface active agents that are preferred for use in the present invention are the polyalkylene oxides with molecular weights of at least 600 described in JP-B-58-9412.

Surface active agents containing fluorine are particularly preferred (for example, as disclosed in U.S. Pat. No. 4,201,586 and JP-A-60-80849) as antistatic agents.

It is possible for the photographic material used in the present invention to contain dispersions of water soluble or hardly soluble polymers, for the purpose of improving dimensional stability, such as alkyl (meta)acrylates, alkoxyalkyl (meta)acrylates and glycidyl (meta)acrylates alone or in combination, as monomer ingredients in combination with acrylic acid and methacrylic acid.

The photographic material of the present invention may also contain hydroquinone derivatives (the so-called DIR-hydroquinones) that release development inhibitors in proportion to the amount of developed images, in the emulsion layer or another hydrophilic colloid layer.

The photographic material used in the present invention may include quaternary onium salts or amine compounds as described in JP-A-62-280733, for the purpose of accelerating development.

It is preferred that a compound having an acid group be present, in the silver halide emulsion layer or in another layer of the photographic material of the present invention. Examples of compounds with acid groups are organic acids such as salicylic acid, acetic acid and ascorbic acid, and polymers or copolymers having repeating units of acid monomers such as acrylic acid, maleic acid and phthalic acid. These compounds are described in Japanese Patent Application No. 60-561179, JP-A-61-228437, JP-A-62-25745 and JP-A-62-55642. Among the low molecular weight compounds ascorbic acid is particularly preferred, and among high molecular weight compounds water-dispersible latexes of copolymers comprising crosslinkable monomers having two or more unsaturated groups such as divinylbenzene, and acid monomers such as acrylic acid are preferred.

Gelatin such as lime-treated gelatin, acid-treated gelatin and gelatin derivatives is preferably used as the binder or protective colloid in the photographic material, but other hydrophilic synthetic macromolecules may also be used. Specific description of these materials appear in *Research Disclosure,* Volume 176, No. 17643, (December 1978), Section IX.

The photographic material used in the present invention can also include, in addition to the silver halide emulsion layer, hydrophilic colloid layers such as a surface protective layer, an intermediate layer, a filter layer and an anti-halation layer.

The photographic material used in the present invention can also have a back layer on the opposite surface for purposes such as front-and-back distinguishability, anti-curling properties and halation prevention.

It is preferred that the back layer used in the present invention contain a matting agent with a relatively large mean grain size, preferably of 1.0 μm to 10 μm, more preferably 2.0 μm to 5.0 μm in view of antiadhesive property.

Homopolymers of methyl methacrylate and copolymers of methyl methacrylate and methacrylic acid, and magnesium oxide can be used as matting agents, in the surface protective layer, and the silicone compounds described in U.S. Pat. Nos. 3,489,576 and 4,047,958, the colloidal silica described in JP-B-56-23139, as well as paraffin wax, higher fatty acid esters and starch can be used as slipping agents, in the surface protective layer.

Polyols such as trimethylol propane, pentane diole, butane diole, ethylene diole and glycerine can be used as plasticizers in the hydrophilic colloid layers.

Stable developers can be used to obtain photographic properties of high sensitivity and supercontrast with the silver halide photographic material of the present invention, without any need to use conventional infectious developers or high alkali developers with a pH close to a pH of 13, as described in U.S. Pat. No. 2,419,975.

That is, the silver halide photographic material of the present invention provides photographic properties of high sensitivity with sufficient supercontrast, with a developer having a pH of 9.5 to 11.2 and containing 0.15 mol/l or more of sulfite ions as preservative.

While there are no particular restrictions as to the developing agents used in the developer of the present invention, it is preferred that the developer contains dihydroxybenzenes from the standpoint of good dot image quality, and further, mixtures of dihydroxybenzenes and 1-phenyl-3-pyrazolidones or mixtures of dihydroxybenzenes and p-aminophenols are preferred from the standpoint of developing performance.

Dihydroxybenzene developing agents which can be used in the present invention include hydroquinone, chlorohydroquinone, isopropylhydroquinone and methylhydroxyquinone, with hydroxyquinone being particularly preferred.

Suitable 1-phenyl-3-pyrazolidones can be 1-phenyl-3-pyrazolidone, 1-phenyl-4,4-dimethyl-3-pyrazolidone and 1-phenyl-4-methyl-4-hydroxymethyl-3-pyrazolidone.

Suitable p-aminophenols can be N-methyl-p-aminophenol, p-aminophenol, N-(β-hydroxyethyl)-p-aminophenol and N-(4-hydroxyphenyl)glycine, but of these, N-methyl-p-aminophenol is preferred.

The developing agent is generally used in an amount of 0.05 mol/l to 0.8 mol/l. Also, when using combinations of dihydroxybenzenes and 1-phenyl-3-pyrazolidones or p-aminophenols, it is preferred to use the former at 0.05 mol/l to 0.5 mol/l, and the latter at 0.06 mol/l or less.

Sulfite preservatives which can be used in the present invention include sodium sulfite, potassium sulfite, lithium sulfite, ammonium sulfite, sodium bisulfite, metapotassium metabisulfite and formaldehydesodium bisulfite. The sulfite salt can be used at a concentration of 0.25 mol/l or more, particularly at 0.3 mol/l or more but preferably not more than 1.2 mol/l because precipitation occurs to stain the developer when it is more than 1.2 mol/l.

The alkali agent used to adjust the pH of the developer can be water soluble inorganic alkali metal salts such as sodium hydroxide and sodium carbonate.

Suitable buffers which can be used in the developer include boric acid as described in JP-A-62-186259, saccharides (for example, saccharose) as described in JP-A-60-93433, oximes (for example, acetooxime), phenols (for example, 5-sulfosalicylic acid) and tertiary phosphates (for example, sodium salts and potassium salts thereof), with boric acid being preferred.

Buffers (preferably having the lst, 2nd and 3rd acid dissociation constants fallen within the range of from $1\times10^{-11}$ to $3\times10^{-13}$) can be added to the developer at 0.1 mol/l or more, and particularly at 0.2 to 1 mol/l. By adding these compounds, the effects of supercontrast and sensitivity increase due to the hydrazines can be obtained in a stable manner even using automatic development equipment, regardless of the silver amount and the ratio of exposed area to entire area of the photographic material being developed.

Additives, other than the above ingredients, that can be present are pH modifiers such as potassium hydroxide and sodium carbonate; development inhibitors such as sodium bromide and potassium bromide; organic solvents such as ethylene glycol, diethylene glycol, triethylene glycol and dimethylformamide; development accelerators such as alkanolamines (e.g., diethanolamine and triethanolamine) and imdazoles or their derivatives; and antifogging agents or black spot prevention agents such as mercapto compounds (e.9., 1-phenyl-5-mercaptotetrazole), indazole compounds (e.g., 5-nitroindazole) and benztriazole compounds (e.g., 5-methylbenztriazole). As desired, color toning agents, surface active agents, defoaming agents, water softeners and hardening agents may also be included.

Fixing agents are thiosulfates such as sodium thiosulfate and ammonium thiosulfate, with ammonium thiosulfate being preferred from the standpoint of fixing speed. The amount of fixing agent used can be varied as suitable, but is ordinarily about 0.1 to about 5 mol/l.

Acidic hardeners in the fixing solutions, are water soluble aluminum salts, chromium salts, and also ethylenediamine tetraacetic acid complexes with trivalent iron compounds as oxidizing agent. Preferred compounds are water soluble aluminum salts such as aluminum chloride, aluminum sulfate and potassium alum. The preferred amount is 0.01 to 0.2 mol/l, with 0.03 to 0.08 mol/l being more preferred.

Suitable dibasic acids which can be present include tartaric acid or its derivatives and citric acid or its derivatives, which may be used alone, or as combinations of two or more. These compounds are effective when present at 0.005 mol or more per 1 l of the fixing solution, and particularly effective at 0.01 to 0.03 mol/l. Specific examples include tartaric acid, potassium tartrate, sodium tartrate, potassium hydrogen tartrate, sodium hydrogen tartrate, sodium potassium tartrate, ammonium tartrate, potassium ammonium tartrate, potassium aluminum tartrate, potassium antimonyl tartrate, sodium antimonyl tartrate, lithium hydrogen tartrate, lithium tartrate, magnesium hydrogen tartrate, potassium boron tartrate and potassium lithium tartrate.

Examples of the citric acid or its derivatives, that are effective in the present invention, are citric acid, sodium citrate, potassium citrate, lithium citrate and ammonium citrate.

As desired, the fixing solution can contain preservatives (for example, sulfites and bisulfites), pH buffers (for example, acetic acid and boric acid), pH adjustors (for example, sulfuric acid) and chelating agents as described above. Here, because the developer solution has high pH, the pH buffers are generally used at 10 to 40 g/l, and more preferably at 18 to 25 g/l.

The fixing temperature and time are generally the same as those for developing, with the preferred being about 20° C. to about 50° C., and 10 seconds to 1 minute.

The present invention is explained in greater by reference to the following Examples.

The developer solution used in the Examples had the following compositions.

| Developer Solution (1) | |
|---|---|
| Hydroquinone | 50.0 g |
| N-Methyl-p-aminophenol · ½ sulfite | 0.3 g |
| Sodium hydroxide | 18.0 g |
| 5-Sulfosalicylic acid | 55.0 g |
| Potassium sulfite | 110.0 g |
| Disodium ethylenediaminetetraacetate | 1.0 g |
| Potassium bromide | 10.0 g |
| 5-Methylbenzotriazole | 0.4 g |
| 2-Mercaptobenzimidazole-5-sulfonic acid | 0.3 g |
| Sodium 3-(5-mercaptotetrazole)benzene-sulfonate | 0.2 g |
| N-n-Butyldiethanolamine | 15.0 g |

-continued

| | |
|---|---|
| Sodium toluenesulfonate | 8.0 g |
| Water to make | 1.0 liter |
| pH | 11.6 |
| Developer Solution (2) | |
| Hydroquinone | 25.0 g |
| 4-Methyl-4-hydroxymethyl-1-phenyl-3-pyrazolidone | 0.5 g |
| Potassium sulfite | 90.0 g |
| Disodium ethylenediaminetetraacetate | 2.0 g |
| Potassium bromide | 5.0 g |
| 5-Methylbenzotriazole | 0.2 g |
| 2-Mercaptobenzimidazole-5-sulfonic acid | 0.3 g |
| Sodium carbonate | 50.0 g |
| Water to make | 1.0 liter |
| (Sodium hydroxide added to make the pH 10.6) | |

COMPARATIVE EXAMPLES

A silver nitrate aqueous solution and a potassium bromide aqueous solution were added simultaneously over a 60 minute period to a gelatin aqueous solution held at 50° C, in the presence of ammonia, by the controlled double jet method with maintaining the electric potential at +55 mV, whereby a mono-dispersed emulsion of cubic grains having a mean grain diameter of 0.27 microns was obtained. After grain formation, the grains were washed in water and dispersed. (Emulsion a.)

To Emulsion a were added $5\times10^{-4}$ per mol of Ag of 1-hydroxyethoxyethyl-3-(2-pyridyl)-5-[3-(4-sulfobutyl)-5-chlorobenzooxazolideneethylidene]-thiohydantoin potassium salt as sensitizing dye, 4-hydroxy-6-methyl-1,3,3a,7-tetrazaindene and a dispersion of polyethyl acrylate, and as a hardener, 3-divinylsulfonyl-2-propanol was further added to Emulsion a. Then hydrazine compound I-15 of the present invention was added in an amount of 8 mg/m$^2$ ($4.5\times10^{-4}$ mol/mol-Ag), and the resulting coating composition was coated onto a polyethylene terephthalate film, so that the coated silver amount was 3.8 g/m$^2$. Thereafter, a gelatin protective layer was provided on the coated layer.

The protective layer was formed by coating a gelatin aqueous solution comprising a dispersion of gelatin, sodium dodecylbenzene sulfonate, a fluorinated surface active agent ($C_8F_{17}SO_2N(C_3H_7)CH_2COOK$), colloidal silica and polyethyl acrylate, polymethyl methacrylate (as a matting agent) and sodium polystyrene sulfonate (as a viscosity increasing agent), so that the coated gelatin amount was 1.6 g/m$^2$.

The thus obtained photographic material was designated Sample A.

In order to investigate the exposure latitude of Sample A, a Ming-style character and a Gothic character were photographed on Sample A with a camera (DSC351, produced by DAINIPPON SCREEN MFG. CO., LTD.) Then the photographic material was developed with developer solution (1) at 34° C. for 30 seconds, fixed, washed and then dried. The exposure conditions were such that a narrow line in a certain portion of the Ming-style character was developed to be 40 microns in width, and the quality (clarity of the character) of the Gothic character developed was evaluated.

The evaluation was done in six stages, with "6" indicating the best quality and "1" the worst quality. "6", "5" and "4" were practical for use, "3" was coarse, but was barely usable, and "2" and "1" were impossible to use.

The quality evaluation of Sample A was 1.

EXAMPLE 1

The same procedure as in Comparative Example was repeated, except that the amount of compound I-15 was increased to 20 mg/m$^2$, and compound II-16 of the present invention was further added to the emulsion in an amount of 150 mg/m$^2$, whereby Sample B was prepared.

Along with Sample B, Samples C to J as shown in Table 1 below were prepared, the latter differing only in the grain size and crystal habit of the silver halide which were varied by changing the temperature and the control potential, respectively.

In order to investigate the exposure latitude in the same manner as in Comparative Example 1, after photography, development was done at 38° C for 30 seconds with developer solution (2). The samples then were fixed, washed in water, dried and then evaluated in the same manner. The gamma value (G) was measured by sensitometry. The results are shown in Table 1 blow.

TABLE 1

| Sample | Emulsion | Crystal Habit | Potential (mV) | Grain Size (μ) | Quality Evaluation | G |
|---|---|---|---|---|---|---|
| B* | a | Cubic | 55 | 0.27 | 4 | 16.0 |
| C | c | 14-hedral | +10 | 0.27 | 6 | 17.2 |
| D | d | 8-hedral | −20 | 0.27 | 6 | 17.8 |
| E* | e | Cubic | +55 | 0.20 | 4–3 | 16.5 |
| F | f | 14-hedral | +10 | 0.20 | 6 | 17.8 |
| G | g | 8-hedral | −20 | 0.20 | 6 | 18.5 |
| H* | h | Cubic | +55 | 0.35 | 5–4 | 15.0 |
| I | i | 14-hedral | +10 | 0.35 | 6 | 16.5 |
| J | j | 8-hedral | −20 | 0.35 | 6 | 16.8 |

*comparative sample

While good image quality is obtained by using compound II-16 and developed with a developer solution having a pH of 10.6, still better results were obtained with octahedral or tetradecahedral grains, regardless of grain size.

EXAMPLE 2

In the same procedure as in the preparation of Sample B, hydrazine compounds I-18, I-19, I-41 and I-45 were each added in an amount of 20 mg/m$^2$, or hydrazine compounds I-30 and I-38 were each added in an amount of 100 mg/m$^2$, in place of hydrazine compound I-15.

The thus prepared Samples K, L, M, N and O were subjected to the same proceedings as in Example 1.

Further, the same procedure was repeated to prepare Samples K', L', M', N', O' and P' using Emulsion c as shown in Table 1 and to prepare Samples K", L", M", N", O" and P" using Emulsion d as shown in Table 1. Thereafter, the thus prepared photographic materials were subjected to the same proceedings as in Example 1.

The results are shown in Table 2 below.

TABLE 2

| Sample | Emulsion | Crystal Habit | Compound of Formula (I) | Compound of Formula (II) | G | Evaluation |
|---|---|---|---|---|---|---|
| K* | a | Cubic | I-18 | II-16 | 12.3 | 3 |
| L* | " | " | I-19 | " | 15.4 | 4 |
| M* | " | " | I-41 | " | 14.3 | 4 |
| N* | " | " | I-45 | " | 13.3 | 3 |
| O* | " | " | I-30 | " | 9.5 | 2 |
| P* | " | " | I-38 | " | 8.2 | 2 |
| K' | c | 14-hedral | I-18 | II-16 | 13.2 | 5 |
| L' | " | " | I-19 | " | 16.4 | 6 |
| M' | " | " | I-41 | " | 15.5 | 6 |
| N' | " | " | I-45 | " | 14.2 | 5 |
| O' | " | " | I-30 | " | 10.2 | 3 |
| P' | " | " | I-38 | " | 9.1 | 3 |
| K" | d | 8-hedral | I-18 | II-16 | 14.4 | 5 |
| L" | " | " | I-19 | " | 17.2 | 6 |
| M' | " | " | I-41 | " | 16.3 | 6 |
| N" | d | 8-hedral | I-45 | II-16 | 15.2 | 5 |
| O" | " | " | I-30 | " | 10.5 | 3 |
| P" | " | " | I-38 | " | 9.5 | 3 |

*comparative sample

It can be understood from the above results that good image quality can be obtained by combinations of the nucleating agent (formula (I)) and the nucleating accelerator (formula (II)) of the present invention, with octahedral and tetradecahedral grains.

While the invention has been described in detail and with reference to specific embodiments thereof, it will be apparent to one skilled in the art that various changes and modifications can be made therein without departing from the spirit and scope thereof.

What is claimed is:

1. An image forming method for forming a black-and-white image with a gamma value of at least 8, comprising:

processing an imagewise exposed negative type photographic material having at least one silver halide emulsion layer on a support, and containing a hydrazine derivative represented by formula (I) and a compound represented by formula (II) in the emulsion layer or in another hydrophilic colloid layer on the support, with a developer having a pH of 11.2 or less, wherein the silver halide grains are octahedral or tetradecahedral grains and the silver bromide content of said grains is at least 70 mol %:

$$R_1-\underset{\underset{A_1}{|}}{N}-\underset{\underset{A_2}{|}}{N}-G_1-R_2 \qquad \text{(I)}$$

wherein $R_1$ represents an aliphatic or aromatic group, $R_2$ represents a hydrogen atom, an alkyl group having 1 to 4 carbon atoms which may be substituted with one or more substituents selected from the group consisting of a halogen atom, a cyano group, a carboxy group, a sulfo group, an alkoxy group, and a phenyl group;

a monocyclic or bicyclic aryl group which may be substituted with one or more substituents selected from the group consisting of a halogen atom, an alkyl group, a cyano group, a carboxyl group, and a sulfo group;

an alkoxy group having 1 to 8 carbon atoms which may be substituted with one or more substituents selected from the group consisting of a halogen atom and an aryl group;

an aryloxy group;

an amino group having up to 10 carbon atoms which may be (i) an unsubstituted amino, or (ii) an arylamino group or an alkylamino group which may be substituted with one or more substituents selected from the group consisting of an alkyl group, a halogen atom, a cyano group, a nitro group, and a carboxy group;

a carbamoyl group having up to 10 carbon atoms which may be (i) an unsubstituted carbamoyl group, or (ii) an arylcarbamoyl group or an alkylcarbamoyl group which may be substituted with one or more substituents selected from the group consisting of an alkyl group, a halogen atom, a cyano group, and a carboxy group, or an aryloxycarbonyl group or an alkoxycarbonyl group having up to 10 carbon atoms which may be substituted with a substituent selected from the group consisting of an alkyl group, a halogen atom, a cyano group, and a nitro group $G_1$ represents a carbonyl group, a sulfonyl group, a sulfoxy group, a

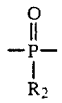

group, or an iminomethylene group, and $A_1$ and $A_2$ each represent a hydrogen atom, or one is a hydrogen atom and the other is a substituted or unsubstituted alkylsulfonyl group, a substituted or unsubstituted arylsulfonyl group, or a substituted or unsubstituted acyl group;

$$Y(-(X)_n-A-B)_m \quad \text{(II)}$$

wherein

Y represents a group capable of adsorption on silver halide;

X represents a divalent linking group comprising an atom or atoms selected from the group consisting of hydrogen atoms, carbon atoms, nitrogen atoms, oxygen atoms, and sulfur atoms;

A represents a divalent linking group;

B represents an amino group, an ammonium group, or a nitrogen-containing heterocyclic ring, wherein the amino group may be substituted;

m represents 1, 2 or 3; and n represents 0 or 1.

2. The image forming method as in claim 1, wherein the aliphatic group represented by $R_1$ has 1 to 30 carbon atoms and is a straight chain, branched chain or cyclic alkyl group, and the aromatic for $R_1$ is a monocyclic or bicyclic aryl group or an unsaturated heterocyclic group.

3. The image forming method as in claim 1, wherein the compound of formula (I) is present in an amount of $1.0\times10^6$ to $5\times10^{-2}$ mol per mol of silver.

4. The image forming method as in claim 1, wherein the compound of formula (II) is present in an amount of $1.0\times10^{-3}$ to 0.5 g/m$^2$.

5. The image forming method as in claim 1, wherein the grain size of the silver halide grains is 0.05 to 0.8 micron.

6. The image forming method as in claim 1, wherein the photographic material contains a sensitizing dye.

* * * * *